US006805627B2

(12) United States Patent
Marts et al.

(10) Patent No.: US 6,805,627 B2
(45) Date of Patent: Oct. 19, 2004

(54) SECURITY COVER FOR VENTILATION DUCT

(75) Inventors: Steven T. Marts, Billings, MT (US); Wayne A. Dykstra, Billings, MT (US)

(73) Assignee: ARC3 Corporation, Billings, MT (US)

( * ) Notice: Subject to any disclaimer, the term of this patent is extended or adjusted under 35 U.S.C. 154(b) by 0 days.

(21) Appl. No.: 10/303,319

(22) Filed: Nov. 22, 2002

(65) Prior Publication Data

US 2003/0104779 A1 Jun. 5, 2003

Related U.S. Application Data

(60) Provisional application No. 60/334,404, filed on Nov. 30, 2001.

(51) Int. Cl.[7] ..... F24F 13/20
(52) U.S. Cl. ..... 454/368; 454/367
(58) Field of Search ..... 454/368, 367, 454/275, 276; 52/198, 199

(56) References Cited

U.S. PATENT DOCUMENTS

| | | | | | |
|---|---|---|---|---|---|
| 3,238,862 | A | * | 3/1966 | Smith et al. | 454/366 |
| 3,710,582 | A | | 1/1973 | McKenzie | |
| 3,902,632 | A | | 9/1975 | Baker et al. | |
| 4,397,225 | A | * | 8/1983 | Patton | 454/368 |
| 4,399,743 | A | * | 8/1983 | Izzi, Sr. | 454/367 |
| 4,530,273 | A | * | 7/1985 | Smith | 454/368 |
| 4,541,544 | A | | 9/1985 | Martin, Jr. et al. | |
| 4,593,504 | A | | 6/1986 | Bonnici et al. | |
| 4,947,596 | A | | 8/1990 | Kight | |
| 4,995,308 | A | | 2/1991 | Waggoner | |
| 5,005,328 | A | * | 4/1991 | Holtgreve | 52/199 |
| 5,435,780 | A | * | 7/1995 | Ayles | 454/199 |
| 5,561,952 | A | * | 10/1996 | Damron | 52/198 |
| 5,662,522 | A | * | 9/1997 | Waltz | 454/359 |
| 5,694,724 | A | | 12/1997 | Santiago | |
| 5,749,780 | A | | 5/1998 | Harder et al. | |
| 5,782,262 | A | | 7/1998 | Kim | |
| 5,798,697 | A | * | 8/1998 | Wiseman | 340/610 |
| 5,816,288 | A | | 10/1998 | Zelch | |
| 6,077,159 | A | | 6/2000 | Clayton | |
| 6,102,794 | A | | 8/2000 | Cline | |
| 6,155,008 | A | | 12/2000 | McKee | |

* cited by examiner

*Primary Examiner*—Derek S. Boles
(74) *Attorney, Agent, or Firm*—Jenkens & Gilchrist

(57) ABSTRACT

An apparatus for covering a vent that prevents material, either solid, liquid or gaseous from entering the vent. A plurality of baffles forms an annular space that provides a tortuous path for materials entering or leaving the vent. An alarm system may be added to the apparatus to alert/warn of tampering.

20 Claims, 2 Drawing Sheets

SECURITY COVER FOR VENTILATION DUCT

PRIOR RELATED APPLICATIONS

This application claims priority to previously filed U.S. Provisional Application Ser. No. 60/334,404 filed on Nov. 30, 2001, which is incorporated by reference herein in its entirety.

FEDERALLY SPONSORED RESEARCH STATEMENT

Not applicable.

FIELD OF THE INVENTION

The invention relates to safety and security covers of new and existing ventilation ducts ("vents") for tanks, buildings, and other infrastructure.

BACKGROUND OF THE INVENTION

Tanks, buildings, and other infrastructure which are vented to the atmosphere are subject to intentional threats and acts of sabotage by vandals or more recently by terrorists through the venting system. Sabotage may include introduction of liquids, gases or solids containing hazardous chemical, biological, or radiological agents into tanks, buildings, and other infrastructure through these vents. The vents common to such tanks, buildings, and other infrastructure are vulnerable to such attacks need a security and alarm system to deny or impede unauthorized access and to alert authorities if an intrusion occurs.

U.S. Pat. No. 4,593,504 discloses a pressure equalizing roof vent. The vent includes apertures near the upper end of a tube. These apertures allow air to exit the tube. However, the apertures are easily tampered with since they are merely covered by a cap which is easily removed.

U.S. Pat. No. 5,694,724 discloses a stacking vent cover. The vent cover does not prevent gases, liquids or solids from being placed down the vent. The vent is open to the atmosphere and tampering is relatively easy, including simply dropping something down the vent.

U.S. Pat. No. 5,816,288 discloses a protective vent cover. The vent is protected by having an inner flexible screen wrapped by an outer heavier more rigid screen. The screens protect the vent from insects and frost. However, the vent is easy to tamper with by simply cutting through the screens which are not protectively covered.

Similar vent covers are known; however, access to the vent is not restricted. Therefore there is a need for a vent cover that would protect the vent from tampering while still being operable.

SUMMARY OF THE INVENTION

The invention to accomplish this protection is a security cover for vents on tanks, building, and other infrastructure. The security cover of this invention may be an add-on fixture to existing vents or as the venting system of a new structure. The configuration of the security cover creates a tortuous path between the interior of the structure and the outside atmosphere, making it difficult for an intruder to introduce a hazardous liquid, gas, or solid material through the vent to invade the interior of the structure. The tortuous path accomplished in the practice of this invention is created by the use of a series of cylindrical baffles which could be called additional pipes to the vent being protected concentrically arranged with an attached cover oriented such that air may enter from the atmosphere through openings proximate to the attached cover and be deflected downwardly by a second concentric baffle toward a base plate which in turn reverses the flow of the air upwardly adjacent a third concentric baffle which terminates with a means for allowing air to pass, such as an offset from the attached cover or openings in the cylindrical baffle, or pipe, allowing the gases to enter the vent on the structure being protected. Of course in instances where pressure inside the tank is greater than the outside pressure, the flow is in the opposite direction. As an optional feature of the interior, an adjustable deflector cone may be attached to the cover cap and over the opening into the structure. In a new structure, the vent pipe for the structure may be constructed integrally with the cylindrical baffles, or pipes, used to create the tortuous path, thus eliminating the need for parts to attach the safety vent to the structure. Of course the description above and later will be made in terms of cylindrical pipes and baffles, it being understood that regardless of the cross-sectional geometry of the vent on the structure being protected, whether retrofit or new construction, the apparatus of this invention can be adapted to fit such cross-sectional geometry.

The security cover is optionally equipped with an alarm system which creates an audible alarm or a transmitter, hardwired or wireless, to arouse protection from a remote location, or both. In the event the security cover is cut or removed, an alarm sounds, a light flashes, and an alert is sent to a remote receiver. Any one or all of these events may occur. The security cover is secured in place using a custom set plate attached to the commonly present vent pipe on existing structures. The set plate has a hasp assembly to accommodate shrouded padlocks or other fasteners of more permanent nature such as, for example, rivets or welded attachment.

Several other design factors are important. The security vent cannot compromise the function of the vent to accommodate suitable air flow. The vent shroud should be made of a material suitable for installation outdoors subject to typical weather conditions on existing or new vents without interfering with operations to the building, tank, or other infrastructure. Finally, the security cover should be readily detachable and reusable.

DETAILED DESCRIPTION OF THE INVENTION

Figure 1:
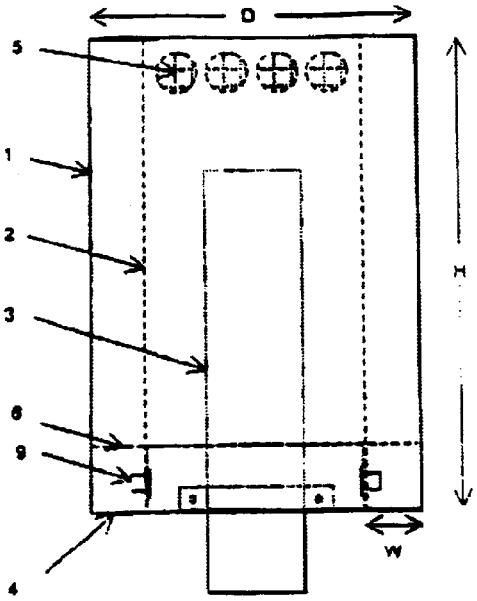
FIG. 1 shows the side view of a cylindrical security cover.

Referring to the annotations on the Drawings, the security cover generally comprises a plurality of concentric baffles 1 and 2, or pipes, see FIG. 1. In a simplified embodiment there are two baffles, an inner baffle 2 and an outer baffle 1, creating an annular space 4 and a tortuous path for air flow. The baffles may be any cross-section shape that is adapted to fit over a new or existing vent 3. The term pipes include any means, for example baffles, that form a tortuous path to the vent. In a preferred embodiment, the baffles are cylindrical and generally concentric. The pipes 1 and 2 are preferably each fastened to a top plate or cover. The top plate is similarly shaped like the pipes. In a preferred embodiment, the top plate is circular. The pipes 1 and 2 are fastened to the top plate by any appropriate fastener known to those skilled in the art, such as welding, bolts, screws, adhesive. The inner pipe 2 preferably has vent cutouts 5 or apertures. The cutouts 5 are shaped, sized and placed on the inner pipe 2 to allow the flow of gases in and out of the vent, yet placed where they are virtually inaccessible from the exterior. In a preferred embodiment, the cutouts 5 are circular in shape and located near, or proximate, the top of the inner pipe or baffle 2. The cutouts 5 are covered by a material, such as wire mesh, gauze, or any other appropriate material that would retard the flow of substances invading the vent. The pipes 1 and 2 and top plate are constructed of any suitable material that is compatible with the vent's application. Generally, the baffles and top plate are metal (i.e., carbon steel, stainless steel, or other), plastic, or fiber composite materials (i.e., fiberglass, Kevlar, or other) that meet the requirements of the application of the vent. In an alternate embodiment, the baffles and top plate are fabricated from an integrally molded article of material.

The diameter, D, and height, H, of the pipes 1 and 2 are sized dependent on the size of the vent, the application and configuration of the vent, and any existing vent cover. The distance, W, of the annular space 4 between the pipes is dependent on the flow conditions of the vent 3. The lower extremity of the annular space 4 may be covered by a material 6, such as mesh, gauze, or any other appropriate material that would retard entry to the vent. In a preferred embodiment, the inner pipe 2 has a larger diameter than the vent 3 and a gas space is formed between the vent 3 and the inner pipe 2. The skilled engineer will be able to size the safety cover of this invention based upon the flow characteristics accommodated by the design of the vent being protected.

In an alternate embodiment, the annular space 4 is filled with a material, such as mesh, gauze, or any other appropriate material that would retard the flow of fluids to/from the vent while in some instances capturing the unwanted materials.

The security cover is attached to the vent 3 by appropriate fasteners, known to one skilled in the art, depending on the configuration of the vent and the associated building, tank, or other infrastructure. In an alternate embodiment, the security cover is coupled to the associated building, tank, or other infrastructure by appropriate fasteners known to one skilled in the art.

Figure 2:
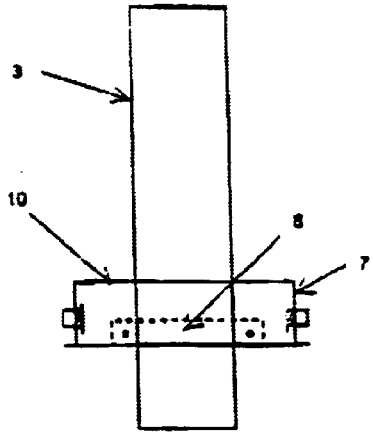
FIG. 2 shows a typical set plate for installations in which the security cover is attached to the vent pipe.
Figure 3:
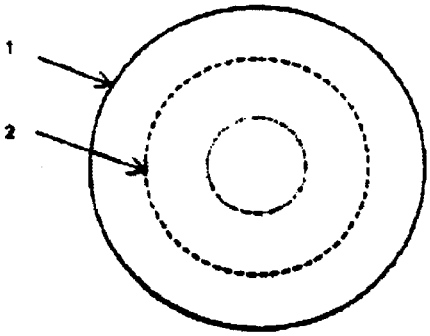
FIG. 3 shows the top view of the security cover.
Figure 4:
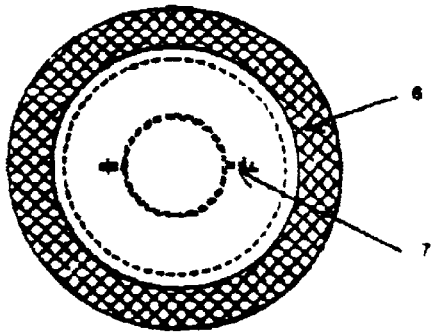
FIG. 4 shows the bottom view of the security cover.

In a preferred embodiment, the security cover is fastened to the vent 3 by a set plate assembly 7 using a friction clamp assembly 8 or by attaching it directly to a flange plate. See FIG. 2. The friction clamps are fastened to the inner top surface of the set plate. The set plate and friction clamps, if used, are constructed of any appropriate material, preferably the same material of construction used for the pipes and top plate. In a preferred embodiment, the set plate and friction clamps are constructed of metal. The security cover is fastened to the set plate 7 using any appropriate locking mechanisms known to those skilled in the art. In a preferred embodiment shown in FIG. 1, the locking mechanism are padlocks secured by a plurality of lock hasps 9. In an alternate embodiment, the lock hasps are spring loaded and retractable to allow the inner cylinder 2 to slip tightly over the set plate. Then the hasps snap through appropriate matching openings in the cylinder of the shroud being attached providing access for the hasp of a padlock.

Figure 5:
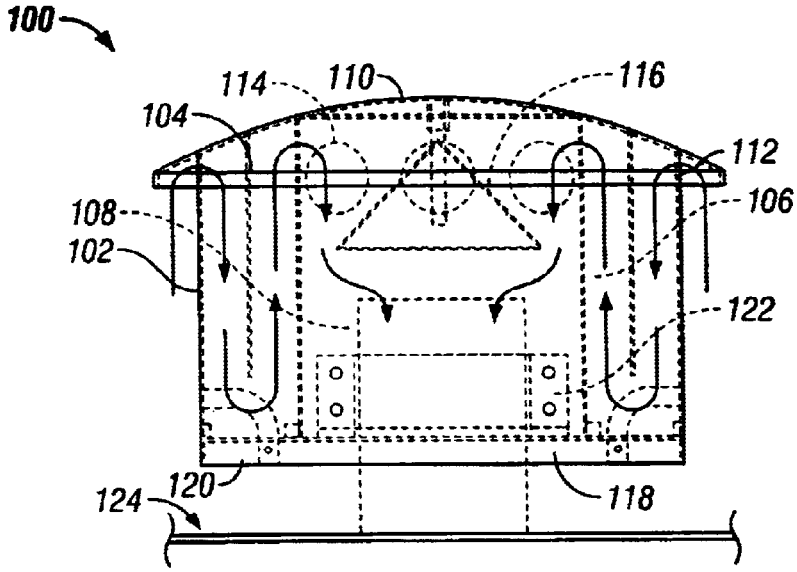
FIG. 5 shows a preferred embodiment for the security cover.

Referring to FIG. 5, the preferred embodiment of the security cover 100 comprises three cylinders, or baffles: a cover cylinder 102, a deflector cylinder 104 and a core cylinder 106. These cylinders are preferably concentric around the vent 108 and spaced apart to form annular spaces creating a tortuous path. In an alternate embodiment, the annular space may be filled with mesh, screen or any other filler which would retard the flow of unwanted material introduced into the system. The cylinders are preferably coupled to a cover cap 110 by any fastening means, preferably welding. The cover cylinder further comprises at least one aperture 112 that is proximate to the cover cap. In a preferred embodiment, there are six such apertures placed about the perimeter of the cover cylinder that are covered by screening. The core cylinder further comprises at least one vent hole 114 that is proximate to the cover cap. In a preferred embodiment, there are six vent holes on the core cylinder that are covered by screening. The vent holes 112 and 114 are sized to allow flow to and from the vent pipe. In an alternate embodiment, a deflector cone 116 is coupled to the cover cap to allow the cone to rise and flow, according to the gas flow, forming an additional obstacle to the gas flow.

For installation, a core base plate 118, including at least one tab, is placed over the vent. The core base plate 118 circumvents the vent. The core base plate 118 further includes lock pin tabs 120. A core collar 122 is inserted into the tabs of the core base plate. The core collar preferably surrounds the vent and is coupled to the vent by any means suitable, preferably bolts or flanges. The security vent, having the cylinders attached to the cover cap 110, is secured to the core base plate via at least one cover lock pin 120 which is attached to the inside wall of the cover cylinder 102. The lock pins are inserted through the core base plate via the lock pin tabs. Fastening means secure the lock pins to the base plate 118, preferably shrouded padlocks or bolts. The cover cylinder 102 and the core cylinder 106 are preferably designed to abut the core base plate 118 forming a tortuous path to the vent, see FIG. 5.

Once attached to the vent, the operation of the security vent cover is as follows. Gas flows through the apertures 112 of the cover cylinder 106 through the annular space between the cover cylinder 106 and the deflector cylinder 104. The cover cap 110 and the core base plate 118 deflect the gas and force it through the annular space and back to the vent holes 114 of the core cylinder 106. As the gas enters the apertures, the gas is further deflected by the deflector cone 116 and finally into the vent 108. If the pressure from the vent is greater than the outside pressure, the flow would be in the other direction.

Figure 6:
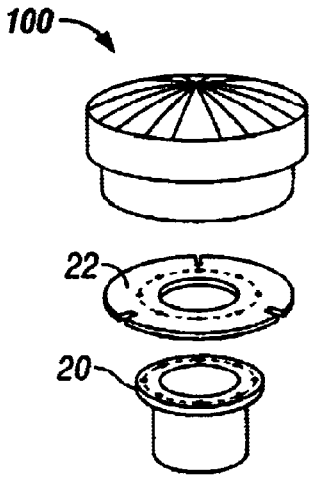
FIG. 6 shows an alternate installation of the security cover to a flanged vent pipe.

Referring to FIG. 6, in an alternate embodiment, the security cover is coupled, using locking bolts and nuts, to a flanged vent 20 via flanges and a vent base plate 22. The vent base plate is coupled to the flanged vent and further include at least one lock pin tab. The security vent 100, including the cylinders and cover cap, is coupled to the vent base plate 22 via the lock pins through the lock pin tabs 120. In an alternate embodiment, the vent base plate further includes at least one tab which further couples the security cover to the vent base plate. The tab is preferably welded to the vent base plate 22. The flanged vent 20 preferably extends at least about 4 inches above the surface of the vessel the vent is coupled to, more preferably at least about 6 inches and most preferably at least about 8 inches to allow room to bolt or otherwise attach the base plate 22 to the flange of the vent.

Figure 7:
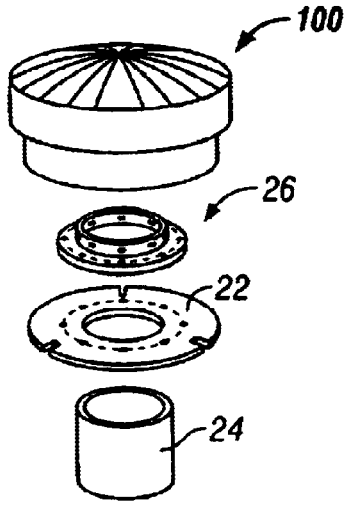
FIG. 7 shows an alternate installation of the security cover to an unflanged vent pipe.

Referring to FIG. 7, in another alternate embodiment, the security cover 100 is coupled to an unflanged vent 24 via the vent base plate 22 which is further coupled to a flange adapter 26. The vent base plate 22 is coupled to the flange adapter 26 and further include at least one lock pin tabs. The security vent 100, including the cylinders and cover cap, is coupled to the vent base plate 22 via the lock pins through the lock pin tabs. In an alternate embodiment, the vent base plate 22 further includes at least one tab 120 which further couples the security cover to the vent base plate. The tab is preferably welded to the vent base plate. The unflanged vent preferably extends at least about 8 inches above the surface of the vessel the vent is coupled to, more preferably at least about 10 inches and most preferably at least about 12 inches.

In an alternate embodiment, an alarm system is included with the security cover. There are many such alarm systems available which responds to tampering or proximity which would be compatible with the security cover of this invention Any such alarm system that alerts the appropriate authorities of intrusion or vandalism known to those skilled in the art may be used. The alarm system's detection capabilities could likely include infrared, sonic/noise, motion, proximity, radar, microwave-based sensors or combinations thereof known to those skilled in the art in addition to physical contact or damage. In a preferred embodiment, for example, the outer pipe 1 and top plate or cover 10 are constructed with a continuous alarm loop wire laid within the cylinder and plate materials. In an alternate embodiment, the continuity alarm loop wire is attached to the interior surface of the outer pipe. In another alternate embodiment, the continuity alarm loop wire is included in a composite material of which the security cover is constructed. The continuity alarm loop wire is any that is known to one skilled in the art.

In another embodiment, the tampering alarm would be a shock or motion detector installed in the outer cylinder of the shroud and connected to the system for spreading alarm. In yet another alternate embodiment, the alarm system further comprises lights, cameras, audible alarms, etc. The alarm system is integrated with the user's Supervisory, Control and Data Acquisition system (SCADA). In another alternate embodiment, the alarm system is capable of alerting the user via a cellular telephone system.

The open space inside the set plate assembly 7 may be used to house the optional alarm circuitry and components. The alarm circuitry and components are any that are known or become known to those skilled in the art. Some applications of the security vent require that alarm circuitry and components be isolated from corrosive or otherwise damaging vapors or gases emitted from the vent. The open space inside the set plate assembly could be divided or compartmented, if necessary, from the remainder of the interior of the inner cylinder 2 by a removal vapor barrier 10 to protect the delicate equipment.

Operation of the vent, with the security cover installed as shown in FIG. 1, has the air flow going into the security cover into the annular space 4 through the screening material 6 to the cutouts 5 of the inner cylinder 2 and, finally, to the vent 3.

In an alternate embodiment, the security cover comprises a plurality of channels that are coupled to form a more tortuous path between the vent pipe and the outside of the vent. The channels may be of substantially any cross-section. The channels may be of substantially any orientation. The tortuous path is created using a plurality of concentric baffles adapted to cause entering (or exiting) gases (usually air or water vapor) to follow a tortuous path regardless of the cross-section or orientation. The plurality of channels may be attached to the vent or to the associated building, tank, or other infrastructure. The plurality of channels is attached by appropriate fasteners known to those skilled in the art.

Having now described the invention in particularity it is respectfully pointed out that those of ordinary skill in the art will be able to make many modifications and variations of the same without departing from the construction of the appended claims.

What is claimed is:

1. A security vent cover for an air vent to inhibit the introduction of hazardous materials through the vent comprising:

an inner baffle coupled to a top plate including one or more inner apertures adjacent to the top plate;

an outer baffle coupled to the top plate; and a fastener coupled the vent to the inner baffle; wherein the inner and outer baffle form an annular space to create a tortuous air flow pathway from the vent to the exterior of the vent cover.

2. The vent cover of claim 1 wherein the annular space is covered by a screening material.

3. The vent cover of claim 1 wherein the annular space is filled with screening a material.

4. The vent cover of claim 1 wherein the inner apertures are covered by a screening material.

5. The vent cover of claim 1 further comprising an alarm system.

6. The vent cover of claim 1 wherein the fastener is a flange plate.

7. Security apparatus for covering a vent comprising, an inner baffle and an outer baffle;

a fastener for coupling the inner baffle to the vent;

a top plate coupled the baffles to form an annular space; and an alarm system coupled to the inner and outer baffles; wherein the inner baffle includes apertures to cause gas to flow through a tortuous path to/from the vent to outside the apparatus; wherein the introduction of hazardous materials through the vent is inhibited.

8. The apparatus of claim 7 wherein the fastener is further coupled to the vent.

9. The apparatus of claim 7 wherein the fastener is further coupled to a structure that includes the vent.

10. The apparatus of claim 7 wherein the annular space is covered by screening material.

11. The apparatus of claim 7 wherein the annular space is filled with screening material.

12. The apparatus of claim 7 wherein the apertures are covered by screening material.

13. The apparatus of claim 7 wherein the fastener is a flange plate.

14. A security cover for a vent comprising, a base plate coupled to the vent, a cap comprising a plurality of baffles with an inner baffle coupled to the be plate, wherein the baffles form a tortuous path between the cap and the base plate to the vent, wherein the cap is coupled to the base plate by a plurality of locking pins.

15. The security cover of claim 14 further comprising an alarm system.

16. The security cover of claim 14 further comprising a collar coupled to the base plate.

17. The security cover of claim 14 wherein the tortuous path is filled with a screening material.

18. A security cover for a vent comprising, a base plate coupled to a collar, wherein the collar is further coupled to the vent, a cap comprising a plurality of baffles coupled to the base plate, wherein the baffles form a tortuous path between the cap and the base plate the vent, wherein the cap is coupled to the base plate by a plurality of locking pins, wherein the collar is further coupled to base plate, wherein there is a cover baffle, a deflector baffle and a core baffle, the cover baffle and core baffle further comprising vent holes.

19. A security cover for a vent comprising, a base plate coupled to a collar, wherein the collar is further coupled to the vent, a cap comprising a plurality of baffles coupled to the base plate, a transmitter, wherein the baffles form a tortuous path between the cap and the base plate to the vent, wherein the cap is coupled to the base plate by a plurality of locking pins, wherein the collar is further coupled to base plate.

20. A security cover for a vent comprising, a base plate coupled to a collar, wherein the collar is further coupled to the vent, a cap comprising a plurality of baffles coupled to the base plate, wherein the baffles form a tortuous path between the cap and the base plate to the vent, wherein the cap is coupled to the base plate by a plurality of locking pins, wherein the collar is further coupled to base plate, and wherein the vent holes are covered by a screening material.

* * * * *